US012391443B1

(12) United States Patent
Yang et al.

(10) Patent No.: US 12,391,443 B1
(45) Date of Patent: Aug. 19, 2025

(54) PACKAGING CONTAINER

(71) Applicant: SHYA HSIN PACKAGING INDUSTRY (CHINA) CO., LTD., Kunshan (CN)

(72) Inventors: Haiying Yang, Kunshan (CN); Changmai Zhang, Kunshan (CN); Cuihong Yang, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 0 days.

(21) Appl. No.: 18/976,285

(22) Filed: Dec. 10, 2024

(30) Foreign Application Priority Data

Apr. 28, 2024 (CN) ..... 202410524137.0

(51) Int. Cl.

| | |
|---|---|
| ***B65D 51/32*** | (2006.01) |
| ***A45D 34/04*** | (2006.01) |
| ***A45D 40/26*** | (2006.01) |
| ***B65D 39/00*** | (2006.01) |

(52) U.S. Cl.
CPC ..... *B65D 51/32* (2013.01); *B65D 39/0052* (2013.01); *A45D 34/045* (2013.01); *A45D 34/046* (2013.01); *A45D 40/265* (2013.01); *A45D 40/267* (2013.01)

(58) Field of Classification Search
CPC .. A45D 34/045; A45D 34/046; A45D 34/047; A45D 40/254; A45D 40/267; A45D 40/268; B65D 39/0052; B65D 51/32
USPC ..... 401/121, 122, 126–130
See application file for complete search history.

(56) References Cited

U.S. PATENT DOCUMENTS 4,403,624 A * 9/1983 Montgomery ..... A45D 40/267 D28/7
5,700,100 A * 12/1997 Ackermann ..... A45D 40/267 401/122

* cited by examiner

*Primary Examiner* — David J Walczak
(74) *Attorney, Agent, or Firm* — Bayramoglu Law Offices LLC

(57) ABSTRACT

A packaging container includes a lid assembly, an applicator, an outer stopper, an inner stopper, and a bottle, where the applicator includes a mounting portion, a connecting portion, and an application portion; two ends of the connecting portion are respectively fixedly connected to the mounting portion and the application portion; the mounting portion is fixedly connected to the lid assembly; the lid assembly covers a bottle mouth of the bottle; the outer stopper is fixedly provided at the bottle mouth of the bottle; the inner stopper is rotatably provided in the outer stopper; a first scraping hole and a second scraping hole communicating with each other are formed in the inner stopper; the first scraping hole is configured to scrape materials on the connecting portion; the second scraping hole is configured to scrape materials on the application portion; and the application portion can drive the inner stopper to rotate.

18 Claims, 13 Drawing Sheets

PACKAGING CONTAINER

CROSS-REFERENCE TO THE RELATED APPLICATIONS

This application is based upon and claims priority to Chinese Patent Application No. 202410524137.0, filed on Apr. 28, 2024, the entire contents of which are incorporated herein by reference.

TECHNICAL FIELD

The present disclosure relates to a cosmetic packaging technology, and in particular to a packaging container.

BACKGROUND

At present, applicators are provided in many cosmetic packaging containers. When used, cosmetic material is directly applied to human skin through an applicator, to not get fingers dirty. Moreover, cosmetic material is applied more uniformly through an applicator. However, since applicators are sheet-like, applicators need to be inserted into an inner stopper according to a fixed direction, which causes inconvenient operation.

SUMMARY

In order to overcome the above defects, the present disclosure provides a packaging container. In the packaging container, the application portion of the applicator can drive the inner stopper to rotate, such that the application portion slides automatically into the second scraping hole of the inner stopper to enter the bottle. Therefore, the present disclosure is used very conveniently.

To solve the technical problems, the present disclosure adopts the following technical solutions:

The present disclosure provides a packaging container, including a lid assembly, an applicator, an outer stopper, an inner stopper, and a bottle, where the applicator includes a mounting portion, a connecting portion, and an application portion; two ends of the connecting portion are respectively fixedly connected to the mounting portion and the application portion; the mounting portion is fixedly connected to the lid assembly; the lid assembly covers a bottle mouth of the bottle; the outer stopper is fixedly provided at the bottle mouth of the bottle; the inner stopper is rotatably provided in the outer stopper; a first scraping hole and a second scraping hole communicating with each other are formed in the inner stopper; the first scraping hole is configured to scrape materials on the connecting portion; the second scraping hole is configured to scrape materials on the application portion; and the application portion is capable of driving the inner stopper to rotate, such that the application portion is inserted into the second scraping hole.

Optionally, a length of the connecting portion extending out of the lid assembly is defined as L1, and a size of a radial section of the lid assembly is defined as L2, $L1 \geq 0.5*L2$.

Optionally, a structure of the lid assembly includes a cylinder; the radial section of the lid assembly is circular; and a radius of the lid assembly is defined as R, $L1 \geq R$.

Optionally, a structure of the connecting portion includes a cylinder; a structure of the application portion includes a sheet-like structure; and a width H of the application portion is greater than a diameter D of the connecting portion.

Optionally, a slot and an oblique plane are arranged on an inner sidewall of the inner stopper; the slot and the oblique plane are spaced apart; an elastic piece is fixedly provided in the slot; and a gap is provided between two elastic pieces to form the second scraping hole.

Optionally, a shape of a radial section of the first scraping hole includes a circle; a shape of a radial section of the second scraping hole includes a square; and a width W of the second scraping hole is less than a thickness T of the application portion.

Optionally, two to four pairs of second scraping holes are formed at a periphery of the first scraping hole; and each pair of second scraping holes are arranged symmetrically along a central axis of the inner stopper.

Optionally; an inner sidewall of the outer stopper extends radially inward to form a circle of protrusion, a circle of clamping groove is formed in an outer sidewall of the inner stopper, the protrusion is provided in the clamping groove to rotatably provide the inner stopper in the outer stopper, and the inner stopper is axially stopped relative to the outer stopper; or a circle of groove is formed in the inner sidewall of the outer stopper, the outer sidewall of the inner stopper extends radially outward to form a circle of bump, the bump is provided in the groove to rotatably provide the inner stopper in the outer stopper, and the inner stopper is axially stopped relative to the outer stopper.

Optionally, a material of the applicator includes a temperature-sensitive material; and the temperature-sensitive material includes metal, alloy, ceramic, glass or stone.

Optionally, the lid assembly includes an outer lid and an inner lid fixedly provided in the outer lid; the mounting portion is fixedly provided in the inner lid; and the inner lid and the bottle are fixed through threaded connection.

The present disclosure has the following beneficial effects: According to the packaging container, the cosmetic material is applied to the skin uniformly through the application portion. Therefore, in the process of applying the cosmetic material, the present disclosure is used more conveniently without getting fingers dirty, applies the cosmetic material more uniformly, and has the better application effect. The inner stopper can rotate relative to the outer stopper. When the application portion of the applicator comes in contact with the inner stopper, if the application portion is not aligned to the second scraping hole of the inner stopper, the application portion can drive the inner stopper to rotate relative to the outer stopper, such that the application portion slides automatically into the second scraping hole. Therefore, when the applicator is inserted into the inner stopper, there is no need to align the application portion to the second scraping hole particularly. The present disclosure is used more conveniently, and saves the makeup time.

Figure 1:
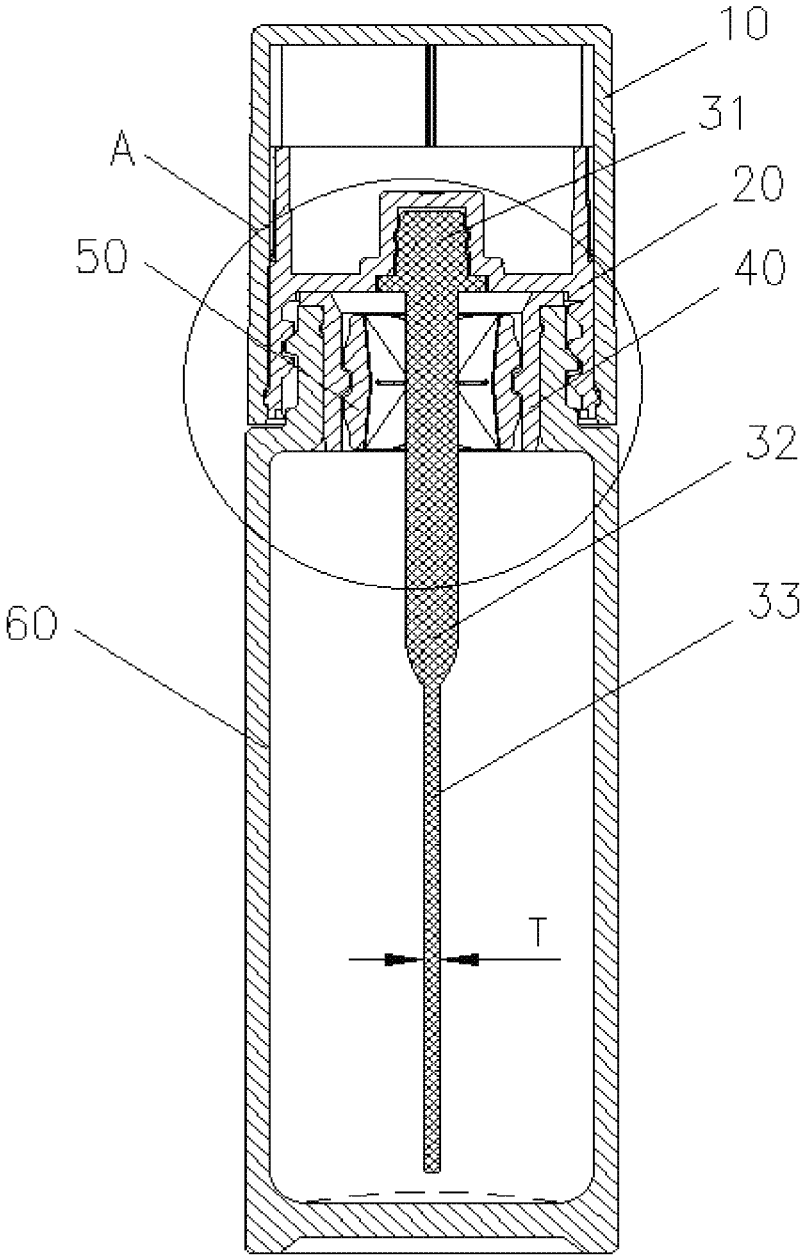
FIG. 1 is a first schematic structural view of a packaging container according to the present disclosure.

In the figures: 10—outer lid, 20—inner lid, 30—applicator, 31—mounting portion, 32—connecting portion, 33—application portion, 40—outer stopper, 41—protrusion, 50—inner stopper, 51—clamping groove, 52—first scraping hole, 53—second scraping hole, 54—slot, 55—oblique plane, 56—elastic piece, and 60—bottle.

DETAILED DESCRIPTION OF THE EMBODIMENTS

The following describes the technical solutions in the embodiments of the present disclosure clearly and completely with reference to the embodiments of the present disclosure. Apparently, the embodiments described are merely some rather than all of the embodiments of the present disclosure. All other embodiments obtained by a person of ordinary skill in the art based on the embodiments of the present disclosure without creative efforts shall fall within the protection scope of the present disclosure.

It should be noted that the terms "first", "second" and so on in the description and claims of the present disclosure and in the above accompanying drawings are intended to distinguish similar objects but do not necessarily indicate a specific order or sequence. It should be understood that the objects used in such a way may be exchanged under proper conditions to make it possible to implement the described implementations of this application in sequences except those illustrated or described herein. Moreover, the terms "include", "have" and their variants mean to cover a non-exclusive inclusion. For example, a process, method, system, product or device that includes a list of steps or units is not necessarily limited to those steps or units which are clearly listed. Instead, they may include other steps or units which are not expressly listed or inherent to such a process, method, product, or device.

For ease of description, spatially relative terms, such as "above", "on the upper side of", "on the upper surface of" and "on", can be used to describe the spatial positional relationship between components or features shown in the figure. It should be understood that the spatially relative terms are intended to encompass different orientations of the components in use or operation in addition to those shown in the figure. For example, if a component in the figure is inverted, it is described as a component "above other component or structure" or "on other component or structure". Therefore, the component will be positioned as "below other component or structure" or "under other component or structure". Therefore, the exemplary term "above" may include both orientations "above" and "below". The component may also be positioned in other different ways (rotated by 90 degrees or in other orientations), but the relative description of the space should be explained accordingly.

Embodiment: As shown in FIGS. 1-13, a packaging container includes a lid assembly, applicator 30, outer stopper 40, inner stopper 50, and bottle 60. The applicator 30 includes mounting portion 31, connecting portion 32, and application portion 33. Two ends of the connecting portion 32 are respectively fixedly connected to the mounting portion 31 and the application portion 33. The mounting portion 31 is fixedly connected to the lid assembly. The lid assembly covers a bottle mouth of the bottle 60. The outer stopper 40 is fixedly provided at the bottle mouth of the bottle 60. The inner stopper 50 is rotatably provided in the outer stopper 40. First scraping hole 52 and second scraping hole 53 communicating with each other are formed in the inner stopper 50. The first scraping hole 52 is configured to scrape materials on the connecting portion 32. The second scraping hole 53 is configured to scrape materials on the application portion 33. The application portion 33 can drive the inner stopper 50 to rotate, such that the application portion 33 is inserted into the second scraping hole 53.

In the present disclosure, the bottle 60 is configured to store a skincare cosmetic material such as a facial cream, a hand cream, and a body cream. When the lid assembly covers the bottle mouth of the bottle 60, the lid assembly and the bottle mouth of the bottle 60 are sealed by the outer stopper 40 and the inner stopper 50. When the lid assembly is pulled out of the bottle 60, the application portion 33 carries a certain amount of the cosmetic material, and the cosmetic material is applied to the skin uniformly through the application portion 33. Therefore, in the process of applying the cosmetic material, the present disclosure is used more conveniently without getting fingers dirty, applies the cosmetic material more uniformly, and has the better application effect. In the process of inserting the applicator 30 into the inner stopper 50, the application portion 33 is inserted into the second scraping hole 53 to pass through the inner stopper 50. In the present disclosure, the inner stopper 50 can rotate relative to the outer stopper 40. When the application portion 33 comes in contact with the inner stopper 50, if the application portion 33 is not aligned to the second scraping hole 53, the application portion 33 can drive the inner stopper 50 to rotate relative to the outer stopper 40, such that the application portion 33 slides automatically into the second scraping hole 53. Therefore, when the applicator 30 is inserted into the inner stopper 50, there is no need to align the application portion 33 to the second scraping hole 53 particularly. The present disclosure is used more conveniently, and saves the makeup time.

Figure 3:
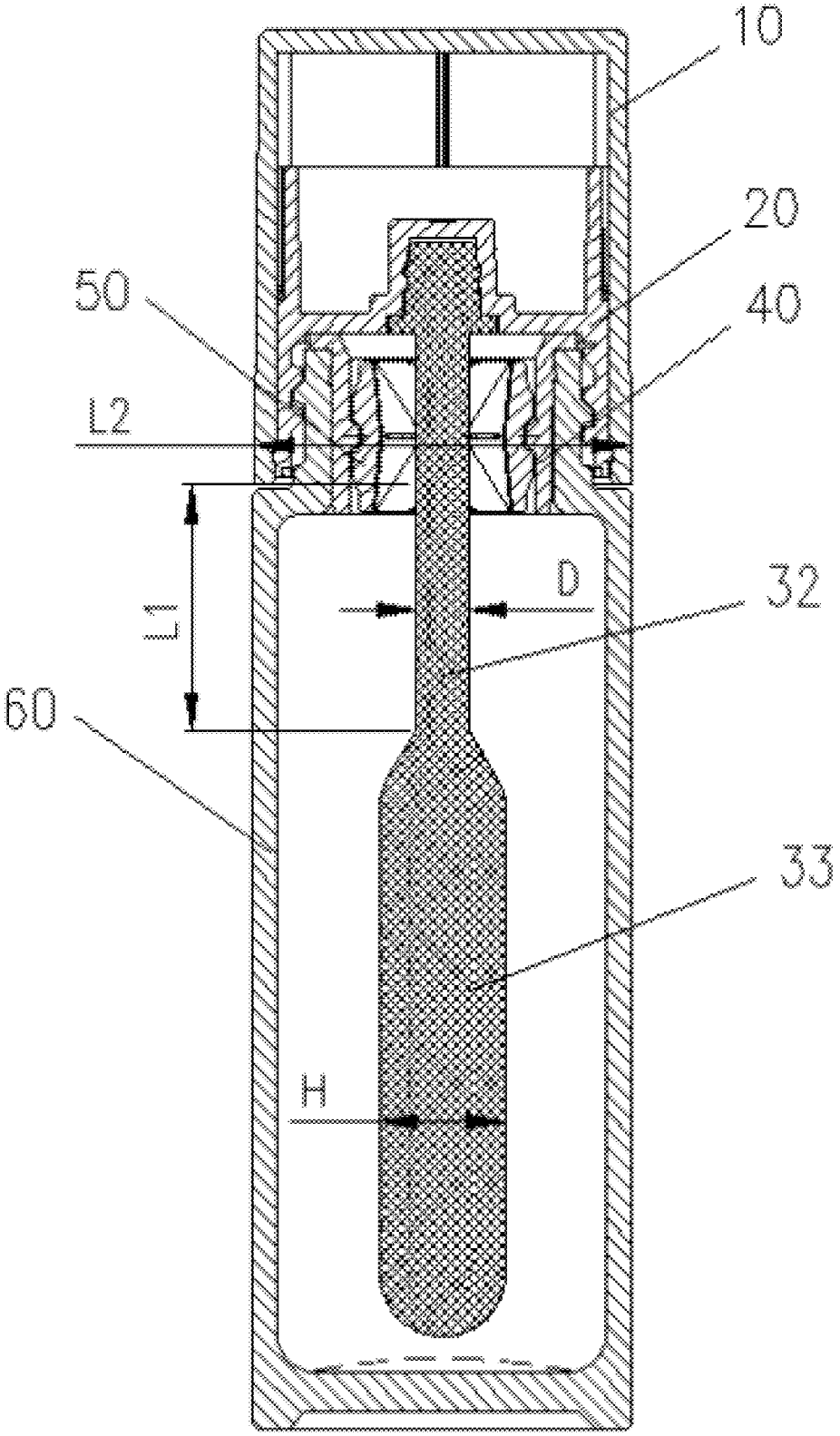
FIG. 3 is a second schematic structural view of a packaging container according to the present disclosure.
Figure 4:
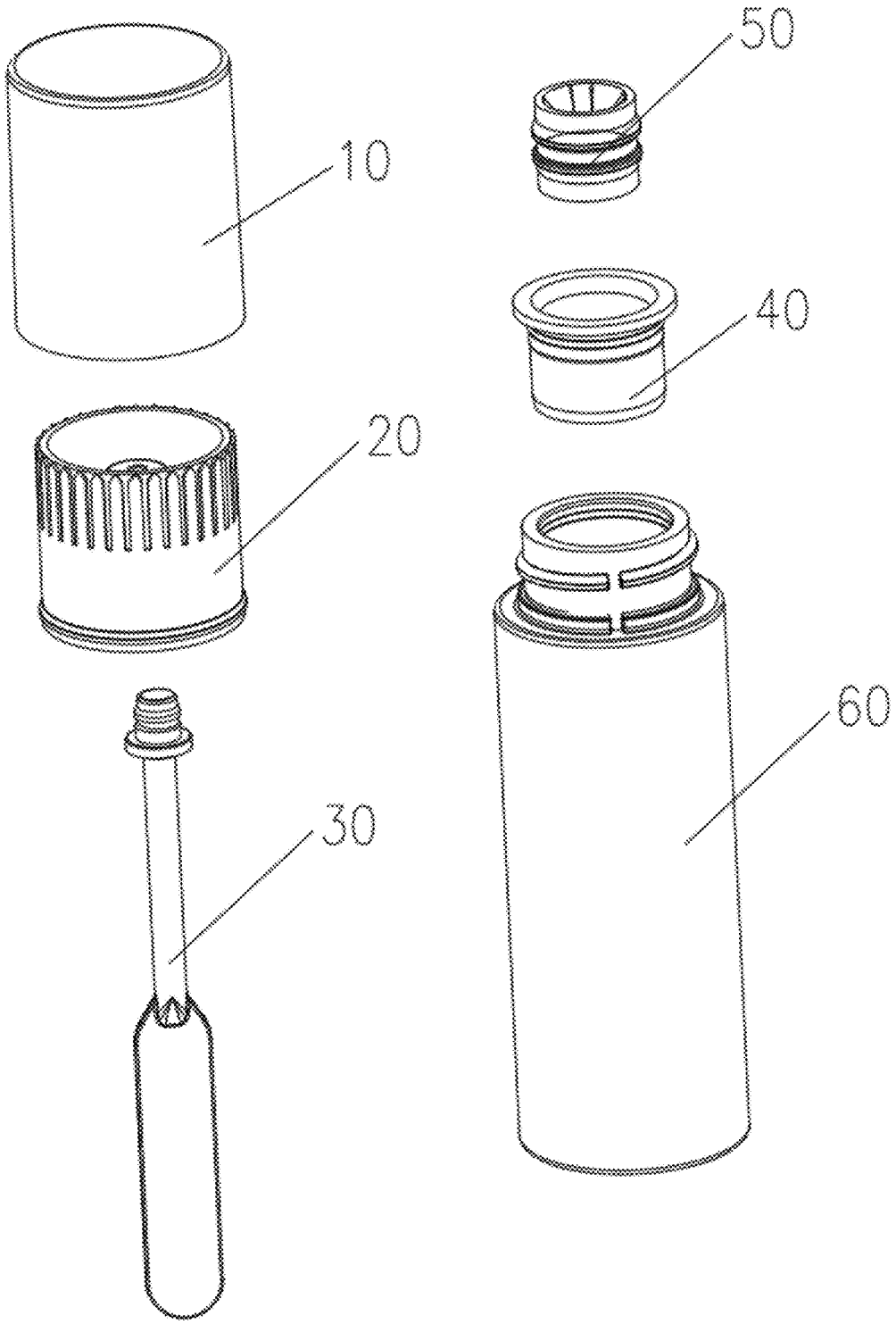
FIG. 4 is an exploded view of a packaging container according to the present disclosure.

Optionally, the applicator 30 is coaxial with the lid assembly. As shown in FIG. 3, a length of the connecting portion 32 extending out of the lid assembly is defined as L1, and a size of a radial section of the lid assembly is defined as L2, $L1 \geq 0.5*L2$. The so-called size of the radial section of the lid assembly refers to a maximum size of the radial section of the lid assembly. For example, when the radial section of the lid assembly is a rectangle, the size of the radial section of the lid assembly is a length of the radial section. When the radial section of the lid assembly is an ellipse, the size of the radial section of the lid assembly is a length of a major axis of the radial section. When the radial section of the lid assembly is circular, the size of the radial section of the lid assembly is a diameter of the radial section. The connecting portion of the conventional applicator has a very short length. When the lid assembly is held by a hand to apply the cosmetic material with the applicator 30, due to obstruction of the lid assembly, a region of the application portion 33 close to the lid assembly cannot come in direct contact with the skin. Hence, the cosmetic material in the region cannot be used to cause a residue for a long time. This not only wastes the cosmetic material, but also is prone to cross-contamination of the cosmetic material to cause a waste of the cosmetic material.

In the present disclosure, the length of the connecting portion 32 extending out of the lid assembly is increased. That is, the connecting portion 32 is used to replace some region of the application portion 33, and the whole application portion 33 can come in contact with the skin in the application process. Hence, the application portion 33 does not suffer the residue of the cosmetic material. Since the cosmetic material on the connecting portion 32 is scraped by the first scraping hole 52, the whole applicator 30 does not suffer the residue of the cosmetic material. By extending the length of the connecting portion 32, the present disclosure solves the waste of the cosmetic material and the cross-contamination.

Optionally, as shown in FIGS. 1-4, a structure of the lid assembly includes a cylinder. The radial section of the lid assembly is circular. A radius of the lid assembly is defined as R, L1≥R. The lid assembly designed as the cylinder meets using habits of people. When the length L1 of the connecting portion 32 extending out of the lid assembly is greater than or equal to the radius R of the lid assembly, all regions of the application portion 33 can come in direct contact with the skin, without the residue of the cosmetic material.

Figure 5:
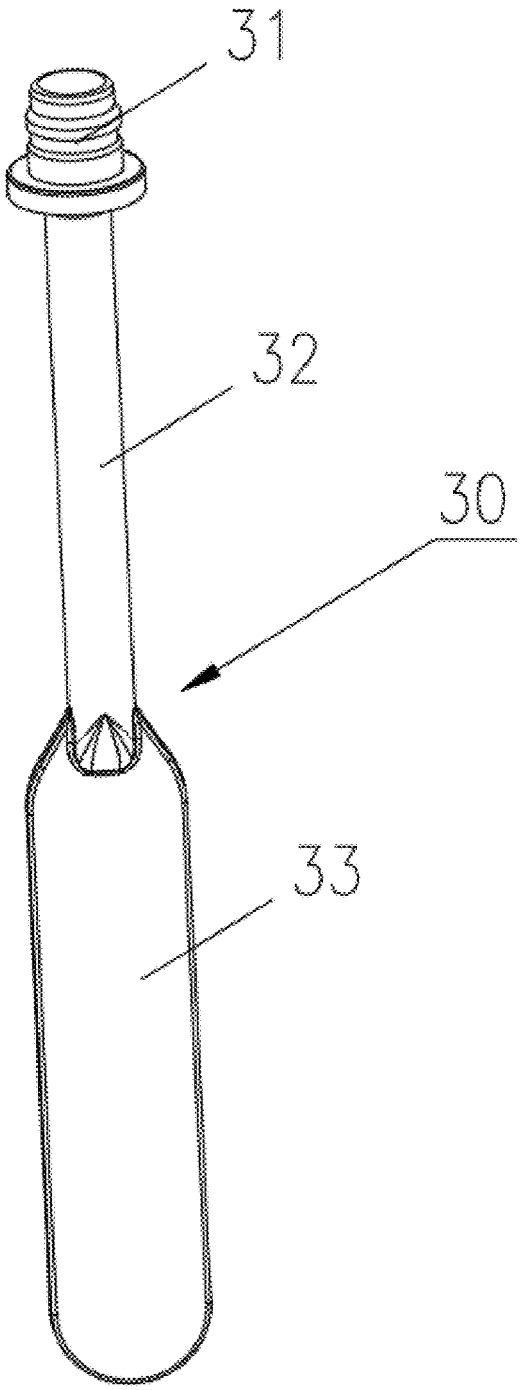
FIG. 5 is a schematic structural view of an applicator according to the present disclosure.
Figure 6:
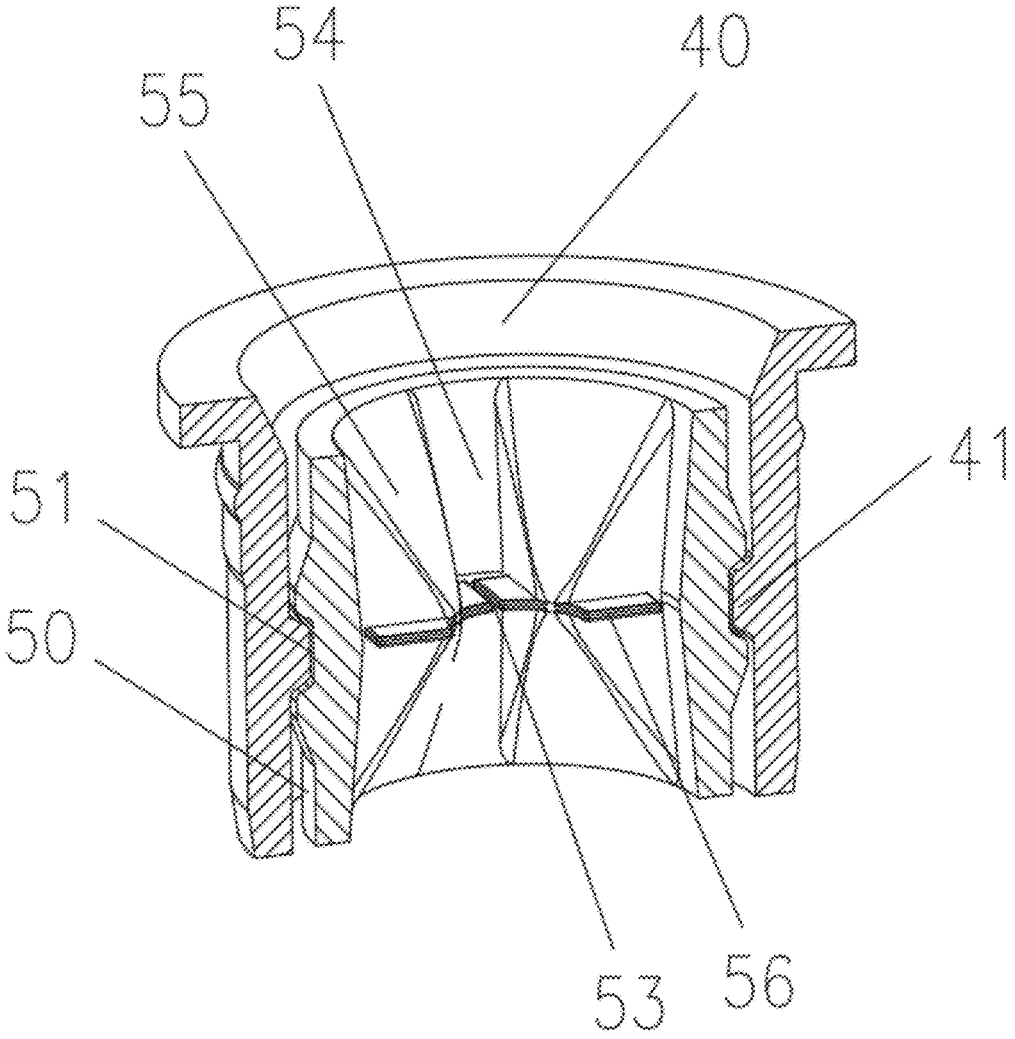
FIG. 6 is an internal structural view of an outer stopper and an inner stopper according to the present disclosure.
Figure 7:
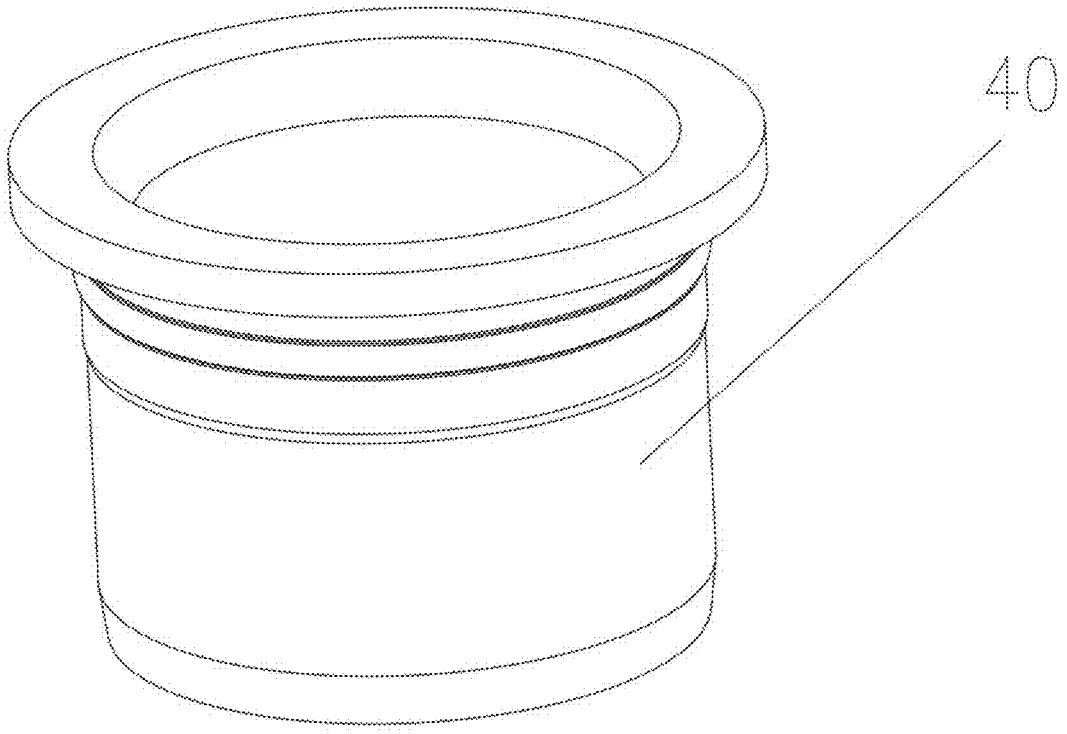
FIG. 7 is a schematic structural view of an outer stopper according to the present disclosure.
Figure 8:
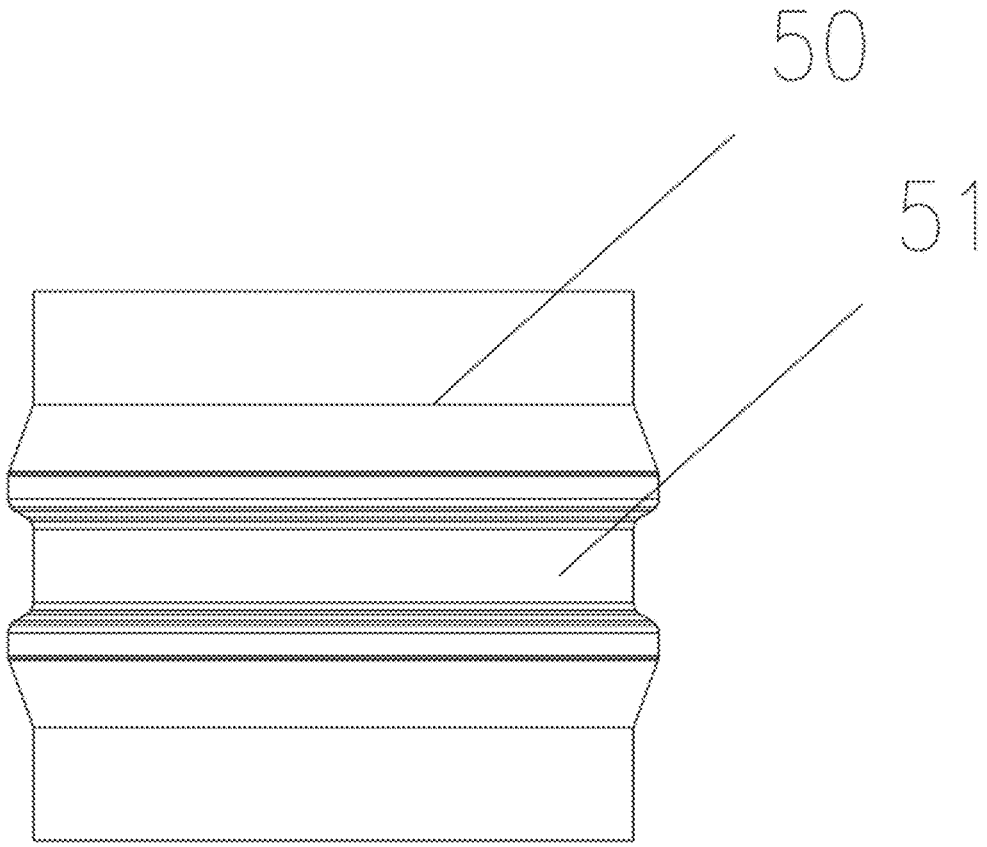
FIG. 8 is a first schematic structural view of an inner stopper according to the present disclosure.
Figure 9:
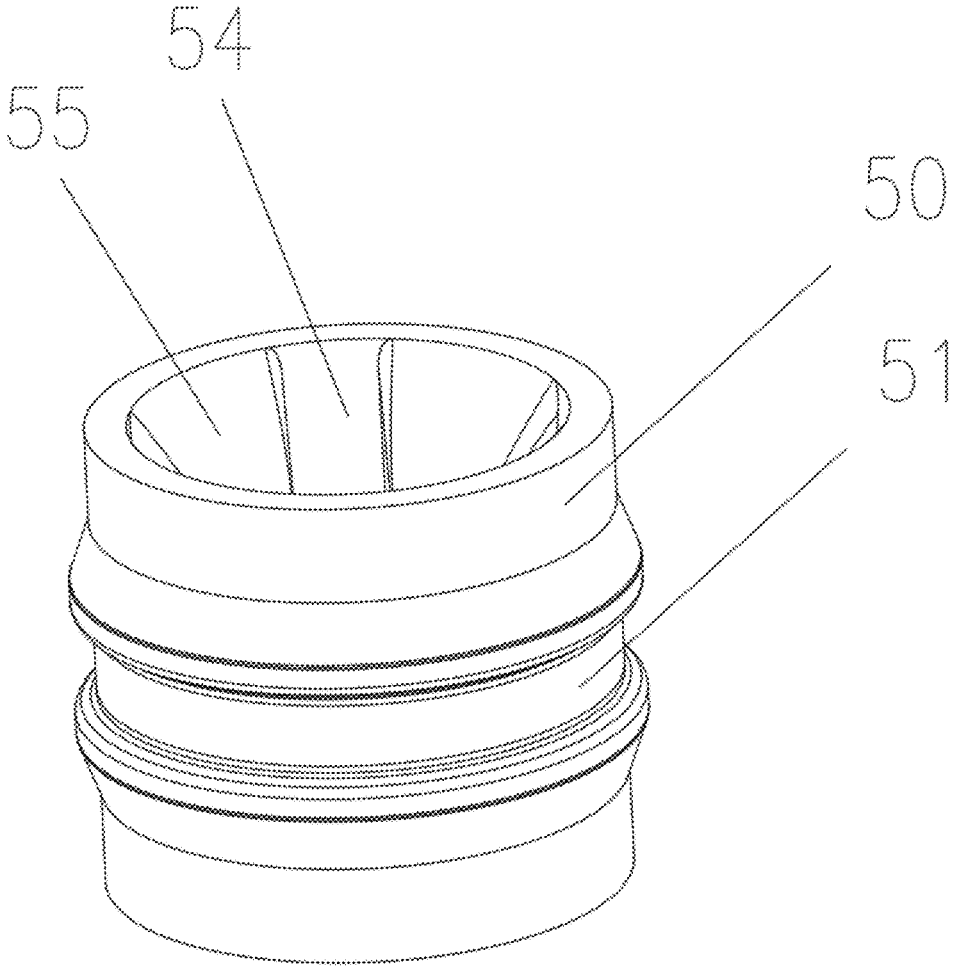
FIG. 9 is a second schematic structural view of an inner stopper according to the present disclosure.
Figure 10:
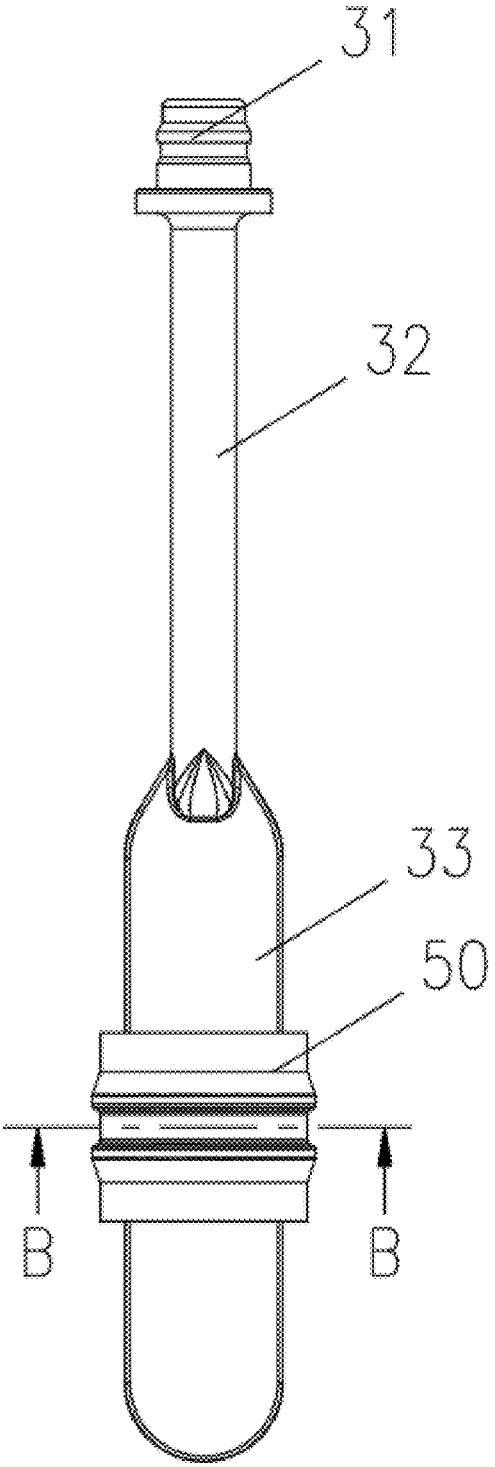
FIG. 10 is a schematic structural view when an applicator is inserted into an inner stopper according to the present disclosure.

As shown in FIG. 1, FIG. 3 and FIG. 5, a structure of the connecting portion 32 includes a cylinder. A structure of the application portion 33 includes a sheet-like structure. A width H of the application portion 33 is greater than a diameter D of the connecting portion 32. The application portion 33 is the sheet-like structure, namely the width H of the application portion 33 is far greater than a thickness T of the application portion 33. The sheet-like application portion 33 is more convenient to disperse the cosmetic material. The diameter D of the connecting portion 32 is less than the width H of the application portion 33. This reduces the usage of the material and the weight of the applicator 30. On the other hand, this facilitates scraping of the second scraping hole 53 for the application portion 33, so as to prevent the application portion 33 from carrying the material excessively to cause the waste and contamination of the material.

As shown in FIGS. 6-9, slot 54 and oblique plane 55 are arranged on an inner sidewall of the inner stopper 50. The slot 54 and the oblique plane 55 are spaced apart. Elastic piece 56 is fixedly provided in the slot 54. A gap is provided between two elastic pieces 56 to form the second scraping hole 53. The slot 54 and the oblique plane 55 are arranged along a circumferential direction of the inner sidewall of the inner stopper 50. Two adjacent slots 54 are spaced apart by the oblique plane 55. Likewise, two adjacent oblique planes 55 are spaced apart by the slot 54. When the applicator 30 is inserted into the bottle 60, if the application portion 33 is aligned fittingly to the slot 54, the application portion 33 can directly pass through the second scraping hole 53 in the slot 54 to enter the bottle 60. Then, the lid assembly covers a bottle mouth of the bottle 60. If the application portion 33 comes in contact with the oblique plane 55, the inner stopper 50 rotates a certain angle under an action of the application portion 33, and then the application portion 33 slides into the slot 54. Hence, the application portion 33 can also pass through the second scraping hole 53. Therefore, there is no need to align the application portion 33 to the second scraping hole 53 particularly in use, and the present disclosure is used very conveniently.

Figure 11:
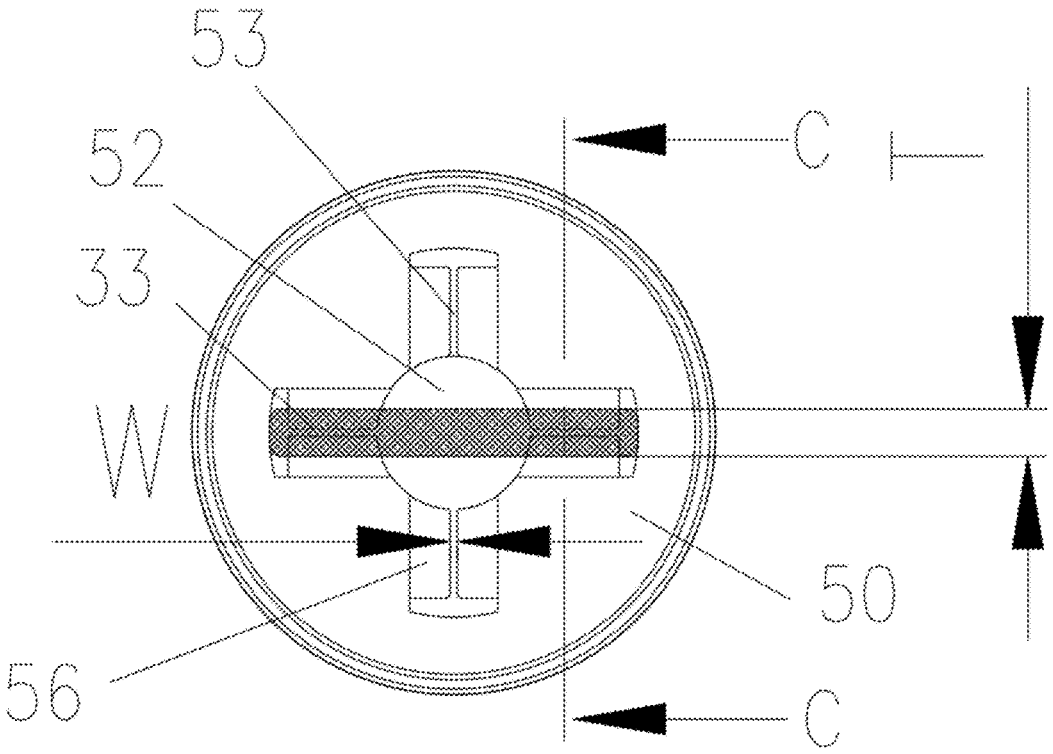
FIG. 11 is a sectional view along B-B shown in FIG. 10.
Figure 12:
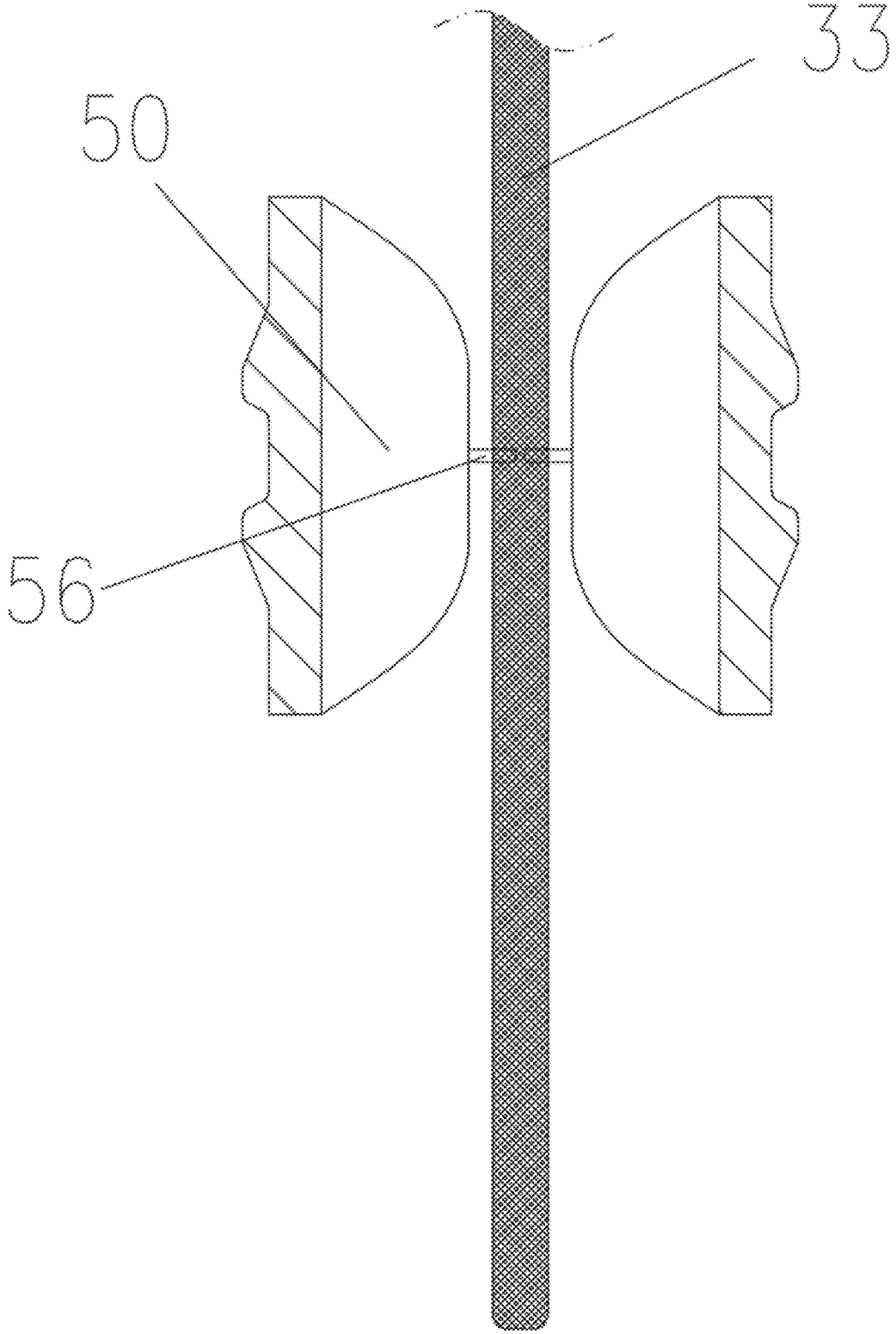
FIG. 12 is a sectional view along C-C shown in FIG. 11.
Figure 13:
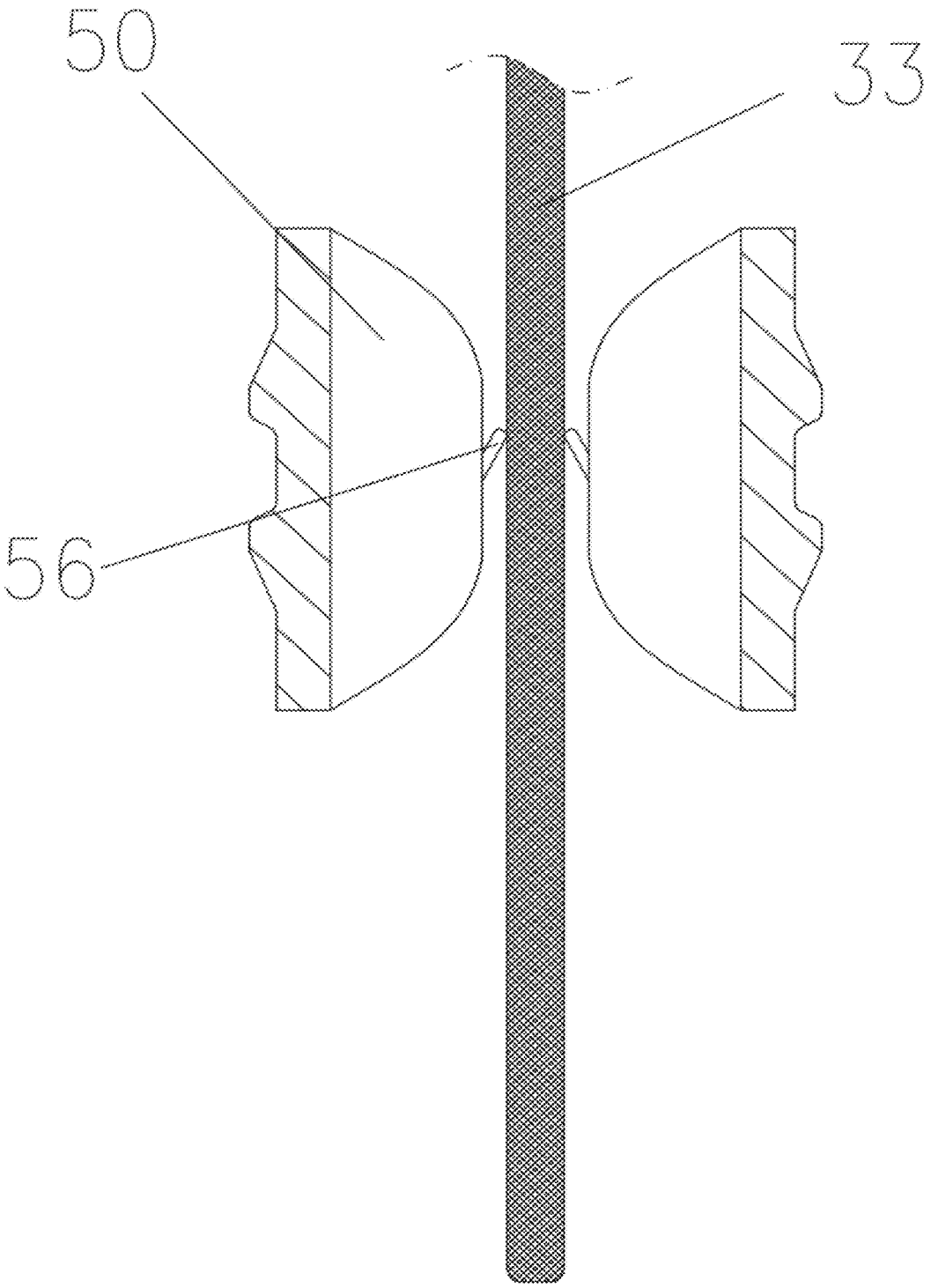
FIG. 13 is a schematic view when an applicator is pulled out according to the present disclosure.

As shown in FIG. 11, a shape of a radial section of the first scraping hole 52 includes a circle. The shape of the radial section of the first scraping hole 52 is the same as a shape of a radial section of the connecting portion 32. A diameter of the radial section of the first scraping hole 52 is less than a diameter of the radial section of the connecting portion 32. This can ensure that the cosmetic material on the connecting portion 32 can be scraped by an edge of the first scraping hole 52 completely. A shape of a radial section of the second scraping hole 53 includes a square. The shape of the radial section of the second scraping hole 53 is the same as a shape of a radial section of the application portion 33. In the embodiment, both the shape of the radial section of the second application hole and the shape of the radial section of the application portion are the square. A width W of the second scraping hole 53 is less than a thickness T of the application portion 33. This ensures that the material on the contacting application portion 33 is scraped by an edge of the second scraping hole 53 completely, keeps the material of the application portion 33 not contacting the edge of the second scraping hole 53, and effectively prevents the application portion 33 from carrying the cosmetic material excessively.

Optionally, two to four pairs of second scraping holes 53 are formed at a periphery of the first scraping hole 52. Each pair of second scraping holes 53 are arranged symmetrically along a central axis of the inner stopper 50. FIG. 11 shows two pairs of second scraping holes 53. The two pairs of second scraping holes 53 are formed into a crisscross. Certainly, there may also be three or four pairs of second scraping holes 53. This not only ensures a certain strength of the inner stopper 50 to guarantee the scraping effect, but also can facilitate insertion of the applicator 30.

Figure 2:
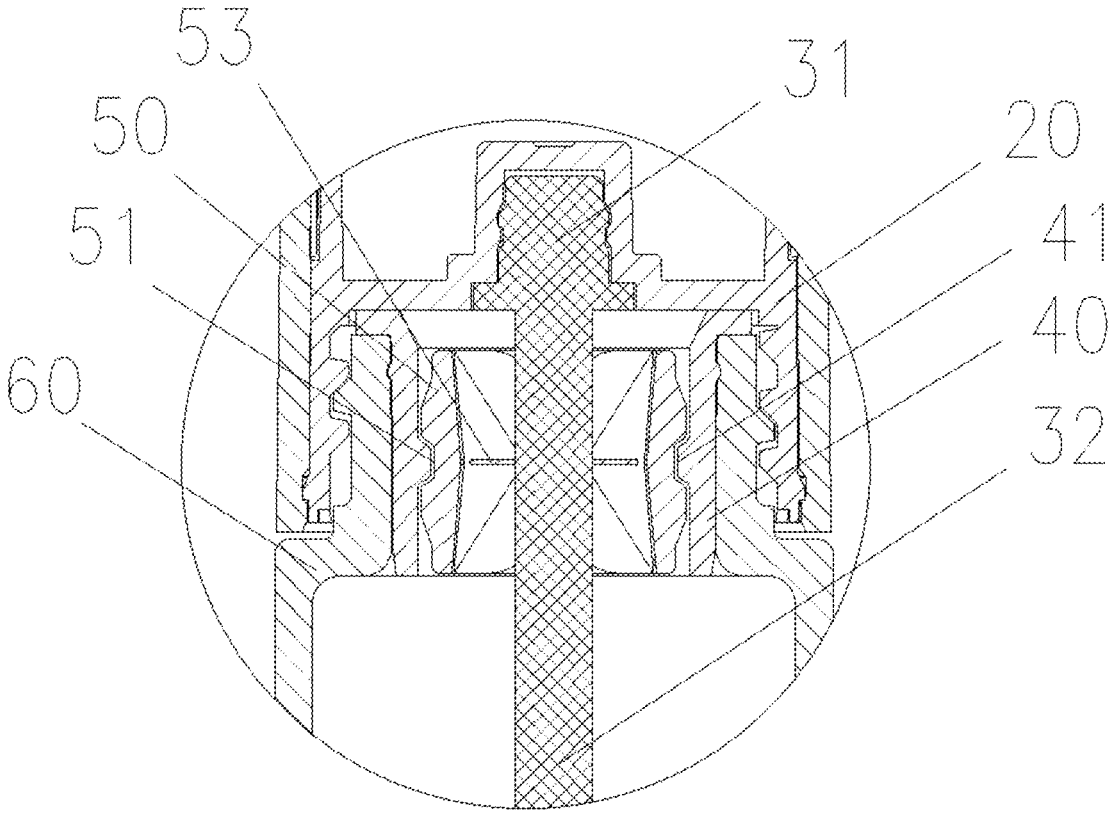
FIG. 2 is an enlarged view of A shown in FIG. 1.

As shown in FIG. 2, in an implementation, an inner sidewall of the outer stopper 40 extends radially inward to form a circle of protrusion 41. A circle of clamping groove 51 is formed in an outer sidewall of the inner stopper 50. The protrusion 41 is provided in the clamping groove 51 to rotatably provide the inner stopper 50 in the outer stopper 40. The inner stopper 50 is axially stopped relative to the outer stopper 40.

In another implementation, a circle of groove is formed in the inner sidewall of the outer stopper 40. The outer sidewall of the inner stopper 50 extends radially outward to form a circle of bump. The bump is provided in the groove to rotatably provide the inner stopper 50 in the outer stopper 40. The inner stopper 50 is axially stopped relative to the outer stopper 40. Certainly, the outer stopper 40 and the inner stopper 50 each may be provided thereon a circle of convex rib. Two convex ribs are clamped to each other, such that the inner stopper 50 and the outer stopper 40 are stopped axially and movable circumferentially.

Optionally, a material of the applicator 30 includes a temperature-sensitive material. The temperature-sensitive material includes metal, alloy, ceramic, glass or stone. When the applicator 30 made of the above temperature-sensitive material comes in contact with the skin, the user feels cool, with pores expanded. Meanwhile, this facilitates shrinkage of the pores after the skincare is penetrated into the pores, and improves the absorption effect of the skin for the skincare.

As shown in FIGS. 1-4, the lid assembly includes outer lid 10 and inner lid 20 fixedly provided in the outer lid 10. The outer lid 10 and the inner lid 20 are fixed by clamping of clamping ribs, glue bonding, ultrasonic welding, etc. The mounting portion 31 is fixedly provided in the inner lid 20. A mounting groove is formed in the inner lid 20. The mounting portion 31 is fixedly provided in the mounting groove by clamping, glue bonding, etc. The inner lid 20 and the bottle 60 are fixed through threaded connection. An inner thread is provided on an inner sidewall of the inner lid 20. An outer thread is provided on an outer sidewall of the bottle 60. The inner lid 20 and the bottle 60 are detachably fixed through threaded connection of the inner thread and the outer thread. In the implementation, the radius of the radial section of the lid assembly is a radius of the outer lid 10, and the length of the connecting portion 32 extending out of the lid assembly is greater than or equal to the radius of the outer lid 10.

The operation process of the present disclosure includes the following steps: First of all, the outer lid 10 is rotated, such that the lid assembly is separated from the bottle 60. The lid assembly is pulled out. Meanwhile, the applicator 30 is taken out, and the material on the connecting portion 32 and in some region of the application portion 33 is scraped by the inner stopper 50. Then, the cosmetic material carried on the application portion 33 is applied to the skin uniformly. Upon completion of application, the applicator 30 is inserted into the inner stopper 50. Since the inner stopper 50 can rotate relative to the outer stopper 40, the application portion 30 passes through the second scraping hole 53 easily to enter the bottle 60. At last, the lid assembly is screwed to the bottle 60.

It should be noted that those of ordinary skill in the art can further make variations and improvements without departing from the conception of the present disclosure. These variations and improvements all fall within the protection scope of the present disclosure. Therefore, the protection scope of the present disclosure shall be subject to the appended claims.

What is claimed is:

1. A packaging container, comprising a lid assembly, an applicator, an outer stopper, an inner stopper, and a bottle, wherein the applicator comprises a mounting portion, a connecting portion, and an application portion;

two ends of the connecting portion are respectively fixedly connected to the mounting portion and the application portion;

the mounting portion is fixedly connected to the lid assembly;

the lid assembly covers a bottle mouth of the bottle;

the outer stopper is fixedly provided at the bottle mouth of the bottle;

the inner stopper is rotatably provided in the outer stopper;

a first scraping hole and a second scraping hole communicating with each other are formed in the inner stopper;

the first scraping hole is configured to scrape materials on the connecting portion;

the second scraping hole is configured to scrape materials on the application portion; and the application portion is allowed for driving the inner stopper to rotate, wherein the application portion is inserted into the second scraping hole.

2. The packaging container according to claim 1, wherein a length of the connecting portion extending out of the lid assembly is defined as L1, and a size of a radial section of the lid assembly is defined as L2, $L1 \geq 0.5*L2$.

3. The packaging container according to claim 2, wherein the lid assembly comprises an outer lid and an inner lid fixedly provided in the outer lid; the mounting portion is fixedly provided in the inner lid; and the inner lid and the bottle are fixed through threaded connection.

4. The packaging container according to claim 2, wherein a structure of the lid assembly comprises a cylinder; the radial section of the lid assembly is circular; and a radius of the lid assembly is defined as R, $L1 \geq R$.

5. The packaging container according to claim 4, wherein the lid assembly comprises an outer lid and an inner lid fixedly provided in the outer lid; the mounting portion is fixedly provided in the inner lid; and the inner lid and the bottle are fixed through threaded connection.

6. The packaging container according to claim 1, wherein a structure of the connecting portion comprises a cylinder; a structure of the application portion comprises a sheet-like structure; and a width H of the application portion is greater than a diameter D of the connecting portion.

7. The packaging container according to claim 6, wherein the lid assembly comprises an outer lid and an inner lid fixedly provided in the outer lid; the mounting portion is fixedly provided in the inner lid; and the inner lid and the bottle are fixed through threaded connection.

8. The packaging container according to claim 1, wherein a slot and an oblique plane are arranged on an inner sidewall of the inner stopper; the slot and the oblique plane are spaced apart; an elastic piece is fixedly provided in the slot; and a gap is provided between two elastic pieces to form the second scraping hole.

9. The packaging container according to claim 8, wherein the lid assembly comprises an outer lid and an inner lid fixedly provided in the outer lid; the mounting portion is fixedly provided in the inner lid; and the inner lid and the bottle are fixed through threaded connection.

10. The packaging container according to claim 8, wherein a shape of a radial section of the first scraping hole comprises a circle; a shape of a radial section of the second scraping hole comprises a square; and a width W of the second scraping hole is less than a thickness T of the application portion.

11. The packaging container according to claim 10, wherein the lid assembly comprises an outer lid and an inner lid fixedly provided in the outer lid; the mounting portion is fixedly provided in the inner lid; and the inner lid and the bottle are fixed through threaded connection.

12. The packaging container according to claim 10, wherein two to four pairs of second scraping holes are formed at a periphery of the first scraping hole; and each pair of second scraping holes are arranged symmetrically along a central axis of the inner stopper.

13. The packaging container according to claim 12, wherein the lid assembly comprises an outer lid and an inner lid fixedly provided in the outer lid; the mounting portion is fixedly provided in the inner lid; and the inner lid and the bottle are fixed through threaded connection.

14. The packaging container according to claim 1, wherein an inner sidewall of the outer stopper extends radially inward to form a circle of protrusion, a circle of clamping groove is formed in an outer sidewall of the inner stopper, the circle of protrusion is provided in the circle of clamping groove to rotatably provide the inner stopper in the outer stopper, and the inner stopper is axially stopped relative to the outer stopper; or a circle of groove is formed in the inner sidewall of the outer stopper, the outer sidewall of the inner stopper extends radially outward to form a circle of bump, the circle of bump is provided in the circle of groove to rotatably provide the inner stopper in the outer stopper, and the inner stopper is axially stopped relative to the outer stopper.

15. The packaging container according to claim 14, wherein the lid assembly comprises an outer lid and an inner lid fixedly provided in the outer lid; the mounting portion is fixedly provided in the inner lid; and the inner lid and the bottle are fixed through threaded connection.

16. The packaging container according to claim 1, wherein a material of the applicator comprises a temperature-sensitive material; and the temperature-sensitive material comprises metal, alloy, ceramic, glass or stone.

17. The packaging container according to claim 16, wherein the lid assembly comprises an outer lid and an inner lid fixedly provided in the outer lid; the mounting portion is fixedly provided in the inner lid; and the inner lid and the bottle are fixed through threaded connection.

18. The packaging container according to claim 1, wherein the lid assembly comprises an outer lid and an inner lid fixedly provided in the outer lid; the mounting portion is fixedly provided in the inner lid; and the inner lid and the bottle are fixed through threaded connection.

* * * * *